United States Patent [19]

Tasaka et al.

[11] Patent Number: 4,652,486

[45] Date of Patent: Mar. 24, 1987

[54] MULTI-STRIKE INK RIBBON

[75] Inventors: Motoo Tasaka, Susono; Kazuhiro Hasebe, Numazu, both of Japan

[73] Assignee: Ricoh Company, Ltd., Tokyo, Japan

[21] Appl. No.: 792,554

[22] Filed: Oct. 29, 1985

[30] Foreign Application Priority Data

Oct. 29, 1984 [JP] Japan ..... 59-225946
Jul. 5, 1985 [JP] Japan ..... 60-146590

[51] Int. Cl.[4] ..... B41M 5/00

[52] U.S. Cl. ..... 428/321.3; 106/20; 106/27; 106/28; 400/241.1; 400/241.2; 428/412; 428/522; 428/914

[58] Field of Search ..... 106/20–23, 106/27, 28; 400/241.1, 241.2; 427/146; 428/195, 321.3, 411.1, 914, 412, 522

[56] References Cited

U.S. PATENT DOCUMENTS 3,908,063 9/1975 Rosendale et al. ..... 428/321.3
4,150,187 4/1979 Brown ..... 428/914
4,515,489 5/1985 Kohle et al. ..... 428/321.3

*Primary Examiner*—Bruce H. Hess
*Attorney, Agent, or Firm*—Oblon, Fisher, Spivak, McClelland & Maier

[57] ABSTRACT

A multi-strike ink ribbon comprising a film substrate and an ink layer formed on the substrate, when necessary, with an adhesive layer interposed therebetween, which ink layer comprises as the main components a resinous material and an ink component comprising a coloring agent and an oil component which is not soluble in the resinous material, the oil component containing as an indispensable component a branched saturated primary alcohol, a fatty acid ester thereof or a hydroxy-fatty acid ester thereof.

7 Claims, No Drawings

MULTI-STRIKE INK RIBBON

BACKGROUND OF THE INVENTION

The present invention relates to a multi-strike ink ribbon comprising a film substrate and an ink layer formed thereon, when necessary, with an adhesive layer interposed therebetween, which ink layer comprises as the main components (i) a resinous material and (ii) an ink component comprising an oil component which is not soluble in the resinous material and a coloring agent. More particularly, the present invention relates to a multi-strike ink ribbon having the above-mentioned structure, in which as an oil component a branched saturated primary alcohol, a fatty acid ester thereof or a hydroxy-fatty acid ester thereof is employed.

Recently a film-based multi-strike ink ribbon is replacing the conventional fabric ink ribbons in accordance with the recent wide-spread use of high speed typewriters and word processors, since the multi-strike ink ribbon is capable of yielding clearer, higher quality printed images free from background smearing as compared with the conventional ink ribbons.

Further, in accordance with the recent popularity of graphic pattern printing, there is a great demand for an ink suitable for forming solid black images, line images and thick line images with high image density, free from ink deposition on the background.

This demand stems from the shortcoming of a conventional ink that the background deposition of the ink is apt to occur when the image density is increased, because of the poor permeation into the printing paper and the poor fixing to the paper, so that the printing paper is smeared with the ink by a printing roller in the course of printing. This problem becomes more conspicuous when such a conventional ink is employed in a multi-strike ink ribbon, because in a multi-strike ink ribbon, the ink comprises an oil component and a coloring agent and the image fixing is carried out by the absorption of the ink by the printing paper. It is considered that an oil having a low viscosity will be effective for improving the permeation of the ink into the printing paper. However, when the resinous material employed in the ink layer is soluble in such an oil component, there is the problem that a sponge-like frame cannot be formed by the resinous material, so that a multi-strikable ink ribbon cannot be made.

Furthermore, a volatile oil which evaporates at room temperature and an oil which evaporates at high temperatures are not suitable for a multi-strike ink ribbon even if the evaporation is slight, since by such evaporation the density of the printed images is markedly decreased.

Under such circumstance, a multi-strike ink ribbon which meets the above recent demand has not been available yet.

SUMMARY OF THE INVENTION

It is therefore an object of the present invention to provide a multi-strike ink ribbon capable of yielding clear, high quality printed images free from background smearing, containing an ink component which highly permeates the printing paper.

The above object of the present invention is achieved by a multi-strike ink ribbon comprising a film substrate and an ink layer formed on the substrate, when necessary, with an adhesive layer interposed therebetween, which ink layer comprises as the main components a resinous material and an ink component comprising a coloring agent and an oil component which is not soluble in the resinous material. Specifically, the oil component contains as an indispensable component a branched saturated primary alcohol, a fatty acid ester thereof or a hydroxy-fatty acid ester thereof.

More specifically, the branched primary alcohol has the following formula:

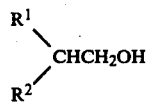

(I)

wherein $R^1$ represents an alkyl group having 6 to 14 carbon atoms, $R^2$ represents an alkyl group having 1 to 14 carbon atoms, and $R^1$ and $R^2$ can be an identical or different alkyl group.

The fatty acid ester or hydroxy-fatty acid ester of the branched primary alcohol has the following formula:

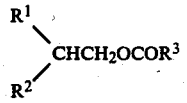

(II)

wherein $R^3$ represents an alkyl group or a hydroxy alkyl group.

DETAILED DESCRIPTION OF THE PREFERRED EMBODIMENTS

Specific examples of a branched primary alcohol having the above-mentioned formula (I) for use in the present invention, in which $R^1$ and $R^2$ each represent an unbranched alkyl group, are as follows:

TABLE 1

| | |
|---|---|
| No. 1-1 | $CH_3(CH_2)_5$ \ CH.$CH_2OH$ / $CH_3(CH_2)_{13}$ |
| No. 1-2 | $CH_3(CH_2)_7$ \ CH.$CH_2OH$ / $CH_3(CH_2)_5$ |
| No. 1-3 | $CH_3(CH_2)_7$ \ CH.$CH_2OH$ / $CH_3(CH_2)_7$ |
| No. 1-4 | $CH_3(CH_2)_7$ \ CH.$CH_2OH$ / $CH_3(CH_2)_8$ |
| No. 1-5 | $CH_3(CH_2)_7$ \ CH.$CH_2OH$ / $CH_3(CH_2)_9$ |
| No. 1-6 | $CH_3(CH_2)_7$ \ CH.$CH_2OH$ / $CH_3(CH_2)_{10}$ |

TABLE 1-continued

| | |
|---|---|
| No. 1-7 | $CH_3(CH_2)_7$ \ $CH.CH_2OH$ / $CH_3(CH_2)_{11}$ |
| No. 1-8 | $CH_3(CH_2)_7$ \ $CH.CH_2OH$ / $CH_3(CH_2)_{12}$ |
| No. 1-9 | $CH_3(CH_2)_7$ \ $CH.CH_2OH$ / $CH_3(CH_2)_{13}$ |
| No. 1-10 | $CH_3(CH_2)_8$ \ $CH.CH_2OH$ / $CH_3(CH_2)_8$ |
| No. 1-11 | $CH_3(CH_2)_8$ \ $CH.CH_2OH$ / $CH_3(CH_2)_9$ |
| No. 1-12 | $CH_3(CH_2)_8$ \ $CH.CH_2OH$ / $CH_3(CH_2)_{10}$ |
| No. 1-13 | $CH_3(CH_2)_8$ \ $CH.CH_2OH$ / $CH_3(CH_2)_{11}$ |
| No. 1-14 | $CH_3(CH_2)_8$ \ $CH.CH_2OH$ / $CH_3(CH_2)_{12}$ |
| No. 1-15 | $CH_3(CH_2)_8$ \ $CH.CH_2OH$ / $CH_3(CH_2)_{13}$ |
| No. 1-16 | $CH_3(CH_2)_9$ \ $CH.CH_2OH$ / $CH_3(CH_2)_9$ |
| No. 1-17 | $CH_3(CH_2)_9$ \ $CH.CH_2OH$ / $CH_3(CH_2)_{10}$ |
| No. 1-18 | $CH_3(CH_2)_9$ \ $CH.CH_2OH$ / $CH_3(CH_2)_{11}$ |
| No. 1-19 | $CH_3(CH_2)_9$ \ $CH.CH_2OH$ / $CH_3(CH_2)_{12}$ |
| No. 1-20 | $CH_3(CH_2)_9$ \ $CH.CH_2OH$ / $CH_3(CH_2)_{13}$ |

TABLE 1-continued

| | |
|---|---|
| No. 1-21 | $CH_3(CH_2)_{10}$ \ $CH.CH_2OH$ / $CH_3(CH_2)_{10}$ |
| No. 1-22 | $CH_3(CH_2)_{10}$ \ $CH.CH_2OH$ / $CH_3(CH_2)_{11}$ |
| No. 1-23 | $CH_3(CH_2)_{10}$ \ $CH.CH_2OH$ / $CH_3(CH_2)_{12}$ |
| No. 1-24 | $CH_3(CH_2)_{10}$ \ $CH.CH_2OH$ / $CH_3(CH_2)_{13}$ |
| No. 1-25 | $CH_3(CH_2)_{11}$ \ $CH.CH_2OH$ / $CH_3(CH_2)_{11}$ |
| No. 1-26 | $CH_3(CH_2)_{11}$ \ $CH.CH_2OH$ / $CH_3(CH_2)_{12}$ |
| No. 1-27 | $CH_3(CH_2)_{11}$ \ $CH.CH_2OH$ / $CH_3(CH_2)_{13}$ |
| No. 1-28 | $CH_3(CH_2)_{12}$ \ $CH.CH_2OH$ / $CH_3(CH_2)_{12}$ |
| No. 1-29 | $CH_3(CH_2)_{12}$ \ $CH.CH_2OH$ / $CH_3(CH_2)_{13}$ |
| No. 1-30 | $CH_3(CH_2)_{13}$ \ $CH.CH_2OH$ / $CH_3$ |
| No. 1-31 | $CH_3(CH_2)_{13}$ \ $CH.CH_2OH$ / $CH_3(CH_2)_{13}$ |

Specific examples of a branched primary alcohol having the above-mentioned formula (I) for use in the present invention, in which at least one of $R^1$ and $R^2$ represents a branched alkyl group, are as follows:

TABLE 2

| | |
|---|---|
| No. 2-1 | $(CH_3)_3CCH_2CH(CH_3)CH_2CH_2$ \ $CHCH_2OH$ / $(CH_3)_3CCH_2CH(CH_3)$ |

TABLE 2-continued

No. 2-2 $CH_3CH(CH_3)-(CH_2)_6$ / $CH_3CH(CH_3)-(CH_2)_4$ > $CHCH_2OH$

No. 2-3 $CH_3(CH_2)_6CH(CH_3)$ / $CH_3(CH_2)_4CH(CH_3)$ > $CHCH_2OH$

No. 2-4 $(CH_3)_3CCH_2CH(CH_3)CH_2CH_2$ / $(CH_3)_3CCH_2CH(CH_3)CH_2CH_2CH_2CH_2$ > $CHCH_2OH$

No. 2-5 $CH_3CH(CH_3)-(CH_2)_6$ / $CH_3CH(CH_3)-(CH_2)_8$ > $CHCH_2OH$

No. 2-6 $(CH_3)_3CCH_2CH(CH_3)CH_2CH_2$ / $CH_3CH_2CH_2CH_2CH_2$ > $CHCH_2OH$

No. 2-7 $(CH_3)_3CCH_2CH(CH_3)CH_2CH_2$ / $CH_3CH_2CH_2CH_2CH_2CH_2CH_2CH_2CH_2$ > $CHCH_2OH$

Specific examples of fatty acids which form fatty acid esters in combination with the above-mentioned branched saturated primary alcohols are as follows: caproic acid, enanthic acid, caprylic acid, undecanoic acid, lauric acid, tridecanoic acid, myristic acid, petadecanoic acid, palmitic acid, stearic acid, oleic acid, elaidic acid, linoleic acid, linolenic acid, stearolic acid, arachic acid, isooctanoic acid, isostearic acid, 9-decenoic acid, 9-undecylenic acid, 10-undecylenic acid, 2-lauroleic acid, 3-dodecenoic acid, 4-dodecenoic acid, 5-lauroleic acid, 11-lauroleic acid, 4-tetradodecenoic acid, 5-myristoleic acid, myristoleic acid, 2-palmitoleic acid, zomaric acid, trans-9-palmitoleic acid, petroselinic acid, petroseelaidic acid, trans-11-octadecenoic acid, cis-11-eicosenoic acid, trans-11-eicosenoic acid, sorbic acid, linoelaidic acid, $\alpha$-eleostearic acid, $\beta$-eleostearic acid, trans-9, trans-12, trans-15-octadecatrienoic acid, pseudoeleostearic acid, 9,11,13,15-octadecatraenoic acid, arachidonic acid and isooleic acid.

Specific examples of hydroxy-fatty acids which form hydroxy-fatty acid esters in combination with the above-mentioned branched saturated primary alcohols are sabinic acid, 16-hydroxypalmitic acid, lanopalmitic acid, ricinoleic acid and dihydroxystearic acid.

A multi-strike ink ribbon according to the present invention can be prepared by a conventional method, for instance, by forming (i) an ink layer comprising as the main components (a) a resinous material and (b) an ink component comprising an oil component which is insoluble in the resinous material and a coloring agent on (ii) a substrate having a thickness of about 7 $\mu$m, made of, for instance, a polyester film, when necessary, with an adhesive layer interposed between the substrate and the ink layer for binding the ink layer to the substrate.

The resinous material contained in the ink layer forms a sponge-like frame and the ink component comprising an oil component and a coloring agent is held within the sponge-like frame. When pressure is applied to the back side of the ink layer for printing, the ink component is ejected from the sponge-like frame, so that the ejected ink component is transferred to the printing sheet, thereby forming printed images thereon. Usually the printed image density does not substantially change even if the same spot at the ink ribbon is struck 3 to 6 times.

Conventionally, as the oil component for use in the ink layer, vegetable non-drying oils such as castor oil and peanut oil are employed because it has the advantage over other conventional oils that they do not deteriorate with time. However, they have the shortcoming that the viscosity thereof is more than 100 cps at 20° C., so that they do not easily permeate the printing paper.

An animal oil having a viscosity of about 80 cps is also proposed for use as the above oil component. However it is not suitable for use in practice because of its unpleasant odor.

Furthermore, a mineral oil having a viscosity of not more than 100 cps is also proposed. However, it contains volatile components and therefore deteriorates with time. The result is that printed image density decreases with time.

In contrast with this, the branched saturated primary alcohols, fatty acid esters thereof and hydroxy-fatty acid esters thereof for use in the present invention have a viscosity ranging from 20 cps to 100 cps at 20° C. and maintain high fluidity at low temperature. Moreover they are thermally stable.

In the present invention, it is preferable that the branched saturated primary alcohols have 15 to 30 carbon atoms, and fatty acid esters thereof and hydroxy-fatty acid esters thereof have 20 to 50 carbon atoms. Further, it is preferable that the fatty acids and hydroxy-fatty acids each have 6 to 20 carbon atoms.

In the present invention, the branched saturated primary alcohols, fatty acid esters thereof and hydroxy-fatty acid esters can be employed as the oil base in the ink layer in combination with other conventional oils. Even if one of such primary alcohols and esters thereof is employed in an amount of approximately 10 wt.% in the total oil components in the ink layer, the smearing of the printing paper by an ink component can be effectively prevented.

A multi-strike ink ribbon according to the present invention is prepared as follows: A resinous material, a coloring agent and a solvent for dissolving the resinous material, when necessary with addition thereto of a low-volatile solvent, are mixed and dispersed in a ball mill to prepare an ink layer formation liquid. The ink layer formation liquid is then coated on the previously mentioned film substrate, thereby preparing a multi-strike ink ribbon.

As mentioned previously, an adhesive layer can be interposed between the film substrate and the ink layer in order to more firmly fix the ink layer to the film substrate. The adhesive layer can be made of, for instance, polyester, polyurethane, polyvinyl acetate, vinyl chloride-vinyl acetate copolymer or acrylic resin.

As the resinous material for use in the ink layer conventionally known resins such as vinyl chloride-vinyl acetate copolymer, polycarbonate and polyvinyl butyral can be employed.

As the coloring agent in the ink layer, the following conventional coloring agents can be employed: Black coloring agents such as carbon black, tri-iron tetroxide and Nigrosine Base; blue coloring agents such as Cyanine Blue, Oil Blue and Alkali Blue; red coloring agents such as Rose Bengale; and other coloring agents such as Crystal Violet and Brilliant Green.

As the solvent for dissolving the resinous material, for instance, for dissolving vinyl chloride-vinyl acetate resin, methyl ethyl ketone, acetone, ethyl acetate, tetrahydrofuran can be employed; and for dissolving polycarbonate, dichloroethane and tetrachloroethane can be employed.

As the low-volatile solvent, toluene, xylene, paraffinic solvents such as Isopar E, G, H, L and M (manufactured by Exxon) can be employed.

In the present invention, oils that can be employed in combination with the branched saturated primary alcohols, fatty acids esters and hydroxy-fatty acid esters are vegetable oils such as linseed oil, soybean oil, rape-seed oil and castor oil; animal oils such as whale oil, lard and beef tallow; and mineral oil such as vaseline, hydrous lanolin, lecithin, DOP(dioctyl phthalate), sodium alkylbenzene sulfonate.

Further, in the present invention, when a hydrous lanolin fatty acid metal salt, such as hydrous lanolin fatty acid barium salt, is contained in the ink layer, the printing quality is improved, possibly because such a metal salt will stabilize the dispersion of the coloring agent in the ink component.

By referring to the following examples, the present invention will now be explained in detail.

EXAMPLE 1

A mixture of the following components was dispersed in a ball mill for 12 hours to prepare an ink layer formation liquid:

| | Parts by Weight |
|---|---|
| Mixture of hydrous lanolin fatty acid barium salt and hydrous lanolin hindered ester | 4 |
| Branched saturated primary alcohol of the following formula (No. 1-9 in Table 1), having a viscosity of 20 cps (at 20° C.) | 16 |
| No. 1-9 $CH_3(CH_2)_7$ \ $CH.CH_2OH$ / $CH_3(CH_2)_{13}$ | |
| Carbon black | 5 |
| Cyanine Blue | 1 |
| Vinyl chloride - vinyl acetate copolymer | 20 |
| Methyl ethyl ketone | 100 |
| Toluene | 40 |

The ink layer formation liquid was coated with a thickness of 15 μm (when dried) on a polyester film having a thickness of 7 μm by a wire bar and was then dried at 100° C., whereby a multi-strike ink ribbon No. 1 according to the present invention was prepared.

EXAMPLE 2

The procedure for Example 1 was repeated except that the formulation in Example 1 was replaced by the following formulation, whereby a multi-strike ink ribbon No. 2 according to the present invention was prepared.

| | Parts by Weight |
|---|---|
| Mixture of hydrous lanolin fatty acid barium salt and hydrous lanolin hindered ester | 4 |
| Oleic acid ester of the following branched saturated primary alcohol (No. 1-23 in Table 1), having a viscosity of 30 cps (at 20° C.) | 16 |
| No. 1-23 $CH_3(CH_2)_{10}$ \ $CH.CH_2OH$ / $CH_3(CH_2)_{12}$ | |
| Carbon black | 5 |
| Cyanine Blue | 1 |
| Vinyl chloride - vinyl acetate copolymer | 20 |
| Methyl ethyl ketone | 100 |
| Toluene | 40 |

EXAMPLE 3

The procedure for Example 1 was repeated except that the formulation in Example 1 was replaced by the following formulation, whereby a multi-strike ink ribbon No. 3 according to the present invention was prepared.

| | Parts by Weight |
|---|---|
| Mixture of hydrous lanolin fatty acid barium salt and hydrous lanolin hindered ester | 4 |
| Branched saturated primary alcohol of the following formula (No. 1-3 in Table 1), having a viscosity of 20 cps (at 20° C.) | 16 |
| No. 1-3 $CH_3(CH_2)_7$ \ $CH.CH_2OH$ / $CH_3(CH_2)_7$ | |
| Carbon black | 5 |
| Cyanine Blue | 1 |
| Vinyl chloride - vinyl acetate copolymer | 20 |
| Methyl ethyl ketone | 100 |
| Toluene | 40 |

EXAMPLE 4

The procedure for Example 1 was repeated except that the formulation in Example 1 was replaced by the following formulation, whereby a multi-strike ink ribbon No. 4 according to the present invention was prepared.

| | Parts by Weight |
|---|---|
| Mixture of hydrous lanolin fatty acid barium salt and hydrous lanolin hindered ester | 4 |
| Ricinoleic acid ester of the following branched saturated primary alcohol (No. 1-31 in Table 1), having a viscosity of 90 cps (at 20° C.) | 16 |
| No. 1-31 $CH_3(CH_2)_{13}$ \ $CH.CH_2OH$ / $CH_3(CH_2)_{13}$ | |
| Carbon black | 5 |
| Cyanine Blue | 1 |
| Vinyl chloride - vinyl acetate copolymer | 20 |
| Methyl ethyl ketone | 100 |
| Toluene | 40 |

EXAMPLE 5

The procedure for Example 1 was repeated except that the formulation in Example 1 was replaced by the following formulation, whereby a multi-strike ink ribbon No. 5 according to the present invention was prepared.

| | Parts by Weight |
|---|---|
| Mixture of hydrous lanolin fatty acid barium salt and hydrous lanolin hindered ester | 4 |
| Branched saturated primary alcohol of the following formula (No. 1-2 in Table 1), having a viscosity of 30 cps (at 20° C.) | 16 |
| No. 1-2 $CH_3(CH_2)_7$ \ $CH.CH_2OH$ / $CH_3(CH_2)_5$ | |
| Carbon black | 5 |
| Cyanine Blue | 1 |
| Vinyl chloride - vinyl acetate copolymer | 20 |
| Methyl ethyl ketone | 100 |
| Toluene | 40 |

EXAMPLE 6

The procedure for Example 1 was repeated except that the formulation in Example 1 was replaced by the following formulation, whereby a multi-strike ink ribbon No. 6 according to the present invention was prepared.

| | Parts by Weight |
|---|---|
| Mixture of hydrous lanolin fatty acid barium salt and hydrous lanolin hindered ester | 4 |
| Myristic acid ester of the following branched saturated primary alcohol (No. 1-2 in Table 1), having a viscosity of 50 cps (at 20° C.) | 16 |

-continued

| | Parts by Weight |
|---|---|
| No. 1-2 $CH_3(CH_2)_7$ \ $CH.CH_2OH$ / $CH_3(CH_2)_5$ | |
| Carbon black | 5 |
| Cyanine Blue | 1 |
| Vinyl chloride - vinyl acetate copolymer | 20 |
| Methyl ethyl ketone | 100 |
| Toluene | 40 |

EXAMPLE 7

A mixture of the following components was dispersed in a ball mill for 12 hours to prepare an ink layer formation liquid:

| | Parts by Weight |
|---|---|
| Mixture of hydrous lanolin fatty acid barium salt and hydrous lanolin hindered ester | 4 |
| Branched saturated primary alcohol of the following formula (No. 2-1 in Table 2), having a viscosity of 50 cps (at 20° C.) | 16 |
| No. 2-1 $(CH_3)_3CCH_2CH(CH_3)CH_2CH_2$ \ $CHCH_2OH$ / $(CH_3)_3CCH_2CH(CH_3)$ | |
| Carbon black | 5 |
| Cyanine Blue | 1 |
| Vinyl chloride - vinyl acetate copolymer | 20 |
| Methyl ethyl ketone | 100 |
| Toluene | 40 |

The ink layer formation liquid was coated with a thickness of 15 μm (when dried) on a polyester film having a thickness of 7 μm by a wire bar and was then dried at 100° C., whereby a multi-strike ink ribbon No. 7 according to the present invention was prepared.

EXAMPLE 8

The procedure for Example 7 was repeated except that the formulation in Example 7 was replaced by the following formulation, whereby a multi-strike ink ribbon No. 8 according to the present invention was prepared.

| | Parts by Weight |
|---|---|
| Mixture of hydrous lanolin fatty acid barium salt and hydrous lanolin hindered ester | 4 |
| Oleic acid ester of the following branched saturated primary alcohol (No. 2-4 in Table 2), having a viscosity of 80 cps (at 20° C.) | 16 |

-continued

| | Parts by Weight |
|---|---|
| No. 2-4 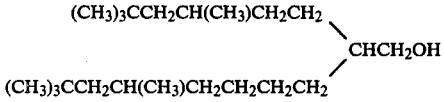 | |
| Carbon black | 5 |
| Cyanine Blue | 1 |
| Vinyl chloride - vinyl acetate copolymer | 20 |
| Methyl ethyl ketone | 100 |
| Toluene | 40 |

COMPARATIVE EXAMPLE

The procedure for Example 1 was repeated except that the formulation in Example 1 was replaced by the following formulation, whereby a comparative multi-strike ink ribbon was prepared.

| | Parts by Weight |
|---|---|
| Mixture of hydrous lanolin fatty acid barium salt and hydrous lanolin hindered ester | 4 |
| Liquid paraffin having a viscosity of 200 cps (at 20° C.) | 16 |
| Carbon black | 5 |
| Cyanine Blue | 1 |
| Vinyl chloride - vinyl acetate copolymer | 20 |
| Methyl ethyl ketone | 100 |
| Toluene | 40 |

Multi-strike ink ribbons No. 1 to No. 8 and comparative multi-strike ink ribbons were subjected to two printing tests, that is, an ordinary printing test at room temperature and a forced printing test, by use of a commercially available printer (Printer RP-1600 produced by Ricoh Company, Ltd.). In the forced printing test, each of the above ink ribbons was wound around a polyester-film-wound paper core in such a manner that the ink layer came into close contact with the polyester film and was placed in a dry box at 70° C. for 24 hours. Ater this, each ink ribbon was allowed to stand at room temperature and was then subjected to the same printing test as in the ordinary printing test.

In order to investigate the smearing of the printing paper with the ink when the printed portions were rubbed, a rubber roller was brought into contact with the printed portions immediately after printing, released from the printed portions and was then brought into contact with the printing paper, so that the ink transfer from the rubber roller to the printing paper was visually inspected.

The results were as follows:

TABLE 3

| | Ordinary Printing Test | | Forced Printing Test | |
|---|---|---|---|---|
| | Image Density | Smearing by rubbing | Image Density | Smearing by rubbing |
| Ex. 1 | 1.25 | None | 1.24 | None |
| Ex. 2 | 1.30 | Slight | 1.28 | Slight |
| Ex. 3 | 1.26 | None | 1.25 | None |
| Ex. 4 | 1.28 | Slight | 1.28 | Slight |
| Ex. 5 | 1.26 | None | 1.25 | None |
| Ex. 6 | 1.27 | Slight | 1.24 | Slight |

TABLE 3-continued

| | Ordinary Printing Test | | Forced Printing Test | |
|---|---|---|---|---|
| | Image Density | Smearing by rubbing | Image Density | Smearing by rubbing |
| Ex. 7 | 1.25 | None | 1.24 | None |
| Ex. 8 | 1.28 | Slight | 1.28 | Slight |
| Comp. Ex. | 1.25 | Considerable | 1.24 | Considerable |

The above results indicate that the multi-strike ink ribbons according to the present invention are capable of yielding printed images having high image density, substantially free from smearing with the ink by rubbing.

What is claimed is:

1. A multi-strike ink ribbon comprising a film substrate and an ink layer formed on the substrate, which ink layer comprises as the main components a resinous material forming a sponge-like frame and an ink component comprising a coloring agent and an oil component which is not soluble in said resinous material, said oil component containing as an indispensable component at least one component selected from the group consisting of:

(a) a branched saturated primary alcohol having a formula of:

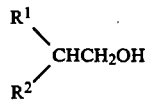

(I)

wherein $R^1$ represents an alkyl group having 6 to 14 carbon atoms, $R^2$ represents an alkyl group having 1 to 14 carbon atoms, and $R^1$ and $R^2$ can be an identical or different alkyl group; and (b) an ester formed from a fatty acid and said branched saturated primary alcohol, having a formula of:

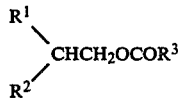

(II)

wherein $R^1$ represents an alkyl group having 6 to 14 carbon atoms, $R^2$ represents an alkyl group having 1 to 14 carbon atoms, $R^1$ and $R^2$ can be an identical or different alkyl group, and $R^3$ represents an alkyl group; and (c) an ester formed from a hydroxy-fatty acid and said branched saturated primary alcohol, having a formula of:

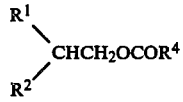

(III)

wherein $R^1$ represents an alkyl group having 6 to 14 carbon atoms, $R^2$ represents an alkyl group having 1 to 14 carbon atoms, $R^1$ and $R^2$ can be an identical or different alkyl group, and $R^4$ represents a hydroxy alkyl group.

2. A multi-strike ink ribbon as claimed in claim 1, wherein said oil component further comprises an oil selected from the group consisting of linseed oil, soybean oil, rapeseed oil, castor oil, whale oil, lard, beef tallow, vaseline, hydrous lanolin, lecithin, DOP(dioctyl phthalate), and sodium alkylbenzene sulfonate.

3. A multi-strike ink ribbon as claimed in claim 1, wherein said fatty acid is selected from the group consisting of caproic acid, enanthic acid, caprylic acid, undecanoic acid, lauric acid, tridecanoic acid, myristic acid, pentadecanoic acid, palmitic acid, stearic acid, oleic acid, elaidic acid, linoleic acid, linolenic acid, stearolic acid, arachic acid, isooctanoic acid, isostearic acid, 9-decenoic acid, 9-undecylenic acid, 10-undecylenic acid, 2-lauroleic acid, 3-dodecenoic acid, 4-dodecenoic acid, 5-lauroleic acid, 11-lauroleic acid, 4-tetradodecenoic acid, 5-myristoleic acid, myristoleic acid, 2-palmitoleic acid, zomaric acid, trans-9-palmitoleic acid, petroselinic acid, petroseelaidic acid, trans-11-octadecenoic acid, cis-11-eicosenoic acid, trans-11-eicosenoic acid, sorbic acid, linoelaidica acid, $\alpha$-eleostearic acid, $\beta$-eleostearic acid, trans-9, trans-12, trans-15-octadecatrienoic acid, pseudoeleostearic acid, 9,11,13,15-octadecatetraenoic acid, arachidonic acid and isooleic acid.

4. A multi-strike ink ribbon as claimed in claim 1, wherein said hydrox-fatty acid is selected from the group consisting of sabinic acid, 16-hydroxypalmitic acid, lanopalmitic acid, ricinoleic acid and dihydroxystearic acid.

5. A multi-strike ink ribbon as claimed in claim 1, further comprising an adhesive layer interposed between said film substrate and said ink layer.

6. A multi-strike ink ribbon as claimed in claim 1, wherein said coloring agent is selected from the group consisting of carbon black, tri-iron tetroxide, Nigrosine Base, Cyanine Blue, Oil Blue, Alkali Blue, Rose Bengale, Crystal Violet and Brilliant Green.

7. A multi-strike ink ribbon as claimed in claim 1, wherein said resinous material is selected from the group consisting of vinyl chloride-vinyl acetate copolymer, polycarbonate and polyvinyl butyral.

* * * * *